United States Patent [19]

Morris et al.

[11] 4,033,267

[45] July 5, 1977

[54] FLUERIC CARTRIDGE INITIATOR

[75] Inventors: Joseph W. Morris, Indian Head, Md.; Bryan L. Cram, Washington, D.C.; Vincent P. Marchese, Morris Township, Morris County, N.J.

[73] Assignee: The United States of America as represented by the Secretary of the Navy, Washington, D.C.

[22] Filed: Oct. 1, 1976

[21] Appl. No.: 728,806

[52] U.S. Cl. ..... 102/70 R; 102/27 R; 102/81

[51] Int. Cl.[2] ..... F42C 5/00

[58] Field of Search ..... 102/70 R, 81, 27 R, 102/39, 49.7; 89/1 B

[56] References Cited

UNITED STATES PATENTS

| | | | |
|---|---|---|---|
| 3,209,692 | 10/1965 | Webb | 89/1 B X |
| 3,238,876 | 3/1966 | Allen | 102/70 R |
| 3,630,150 | 12/1971 | Rakowsky | 102/70 R |
| 3,630,151 | 12/1971 | Rakowsky | 102/70 R |
| 3,854,401 | 12/1974 | Fisher | 102/81 X |
| 3,863,571 | 2/1975 | Campagnuolo et al. | 102/81 |
| 3,945,322 | 3/1976 | Carlson et al. | 102/70 R |
| 3,956,993 | 5/1976 | Corrado | 102/81 |
| 3,982,488 | 9/1976 | Rakowsky et al. | 102/81 |
| 3,985,058 | 10/1976 | Corrado et al. | 102/81 X |

*Primary Examiner*—David H. Brown
*Attorney, Agent, or Firm*—R. S. Sciascia; A. L. Branning; H. B. Field

[57] ABSTRACT

A flueric cartridge initiator comprising a heat resistant or composite material resonance tube, a hardened high strength thermal disk and copper seals, in combination with an ignition train comprising potassium dinitrobenzfuroxane initiating charge, a double-base flake propellant transfer charge, and an extruded multi-perforated main charge propellant.

9 Claims, 7 Drawing Figures

PRIOR ART

FLUERIC CARTRIDGE INITIATOR

BACKGROUND OF THE INVENTION

The present invention is related to a cartridge activated device, and more particularly to gas driven cartridges with no moving parts.

Increased aircraft performance envelopes and variable mission profiles have resulted in more complex aircrew automated escape systems (AAES). Because more stringent AAES performance requirements are needed to ensure safe crewmember recovery, additional maintenance and safety problems with potential consequent degradation of AAES performance and reliability have become apparent.

In order to obtain AAES performance improvement, more accurate sequencing and timing has been required. However, current AAES technology can provide pyrotechnic delay cartridges with an accuracy of only ±15% over the temperature range of −65° F to 200° F. These pyrotechnic time delay cartridges provide nominal fixed time delays for the entire aircraft operational envelope, which are not optimum for all ejection conditions.

The Flueric Cartridge Initiator (FCI), also known as the Flueric Match, was investigated to determine feasibility of pyrotechnic cartridge initiation. The stores separation Cartridge Mk 125 was selected as the test vehicle primarily because of envelope considerations and because it is a worst case condition in regard to gas blowback. Because of FCI and fluidic sequencer operational pressure compatibility, the FCI is being considered for existing firing pin/shear pin replacement. However, problems such as ballistic gas blowback, ignition capability, and function time first need to be solved.

A flueric match had been developed by Singer Kearfott, Little Falls, N. J., and later EMX Engineering Inc., Wayne, N. J., for various military and NASA applications where initiation of explosive and/or propellant was required. These systems as well as the Flueric Match shown in FIG. 1, function when gas is supplied to the input port which consists of a convergent nozzle. The gas exists from the nozzle and impinges on the resonance cavity inlet. Although most of the gas flow exits through the vents on either side of the nozzle, a portion of it is trapped momentarily in the resonance cavity where the gas undergoes successive periods of expansion and compression as shock waves are propagated through the cavity. These shock waves are driven by a standing shock wave which appears just upstream of the resonance cavity inlet. This standing wave oscillates by changing its position in response to the waves traversing the resonance cavity. Temperatures of the trapped gas at the small end of the closed cavity reach 2,000° F within milliseconds of gas supply initiation.

In demonstration tests at Dayton T. Brown, Bohemia, N. Y., it was shown that the flueric match could successfully ignite cartridges but that there was a significant backflow problem because the match components could not withstand the cartridge ballistic gas environment. Thus the goal was to develop a Flueric Cartridge Initiator (FCI) which would withstand ballistic gas pressures and function within current cartridge specification requirements.

SUMMARY OF THE INVENTION

Accordingly, there is provided by the present invention a flueric cartridge initiator capable of withstanding ballistic gas pressures, of a cartridge actuated device and operating within stringent delay times. The FCI comprises a heat resistant or composite material resonance tube, a hardened high strength thermal disk and copper seals, in combination with an ignition train comprising potassium dinitrobenzfuroxane initiating charge, a double-base flake propellant transfer charge, and an extruded multi-perforated main charge propellant.

OBJECTS OF THE INVENTION

It is therefore an object of the present invention to provide a Flueric Cartridge Initiator (FCI) with a heat resistant or composite material resonance tube.

Another object of the present invention is to provide a resonance tube having high shock strength and thermal resistivity.

Yet another object of the present invention is to eliminate backflow through the FCI.

Still a further object of the present invention is to develop a reliable cartridge ignition train.

Yet a further object of the present invention is to ensure reliability of operation from −65° F + 0 + 200° F.

Still another object of the present invention is to develop a Flueric Cartridge Initiator which would operate within stringent time requirements.

Other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Figure 1:
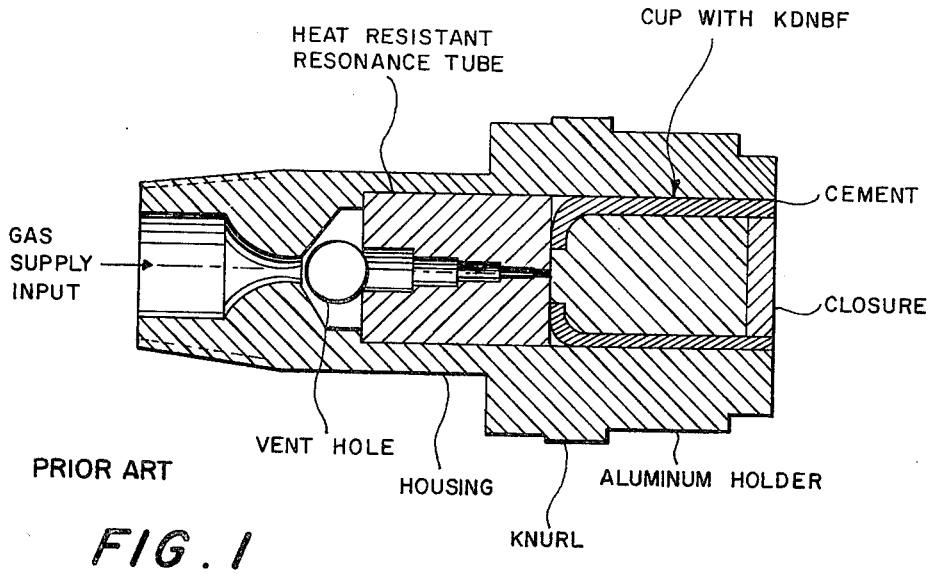
PRIOR ART FIG. 1
FIG. 1, Prior Art, cross-sectional view of Flueric Match.
Figure 2A:
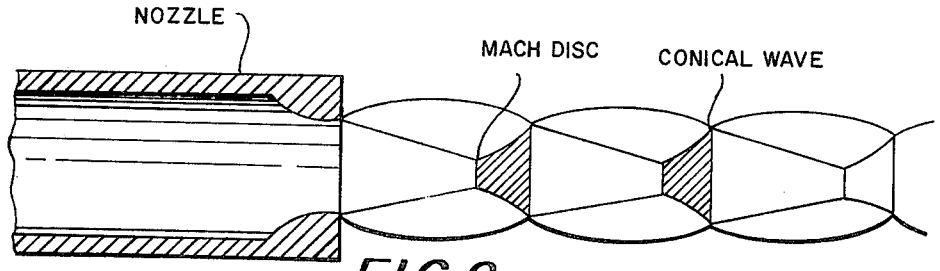
FIG. 2a, Diagrammatical representation of conical waves and Mach Discs.
Figure 2B:
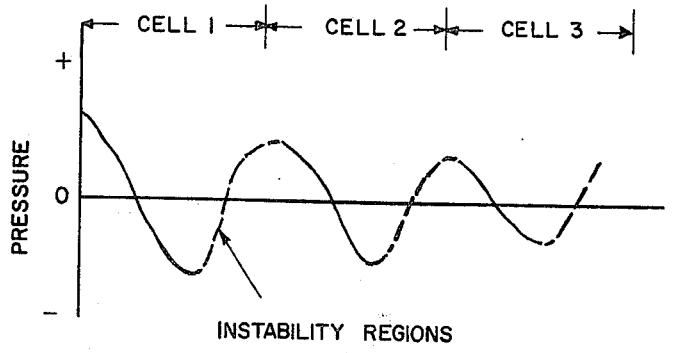
FIG. 2b, Graphical representation of conical shock waves.

The present invention operates when the resonance tube inlet is placed in the compression region of a free jet emanating from the nozzle. As the flow passes through the nozzle, it accelerates to supersonic speed and then readjusts to subsonic speed by compression through a shock wave. The process creates a series of diamond-shaped cells of alternate supersonic and subsonic flow. These cells are conical shock waves (Mach diamonds) intersect the jet axis throughout the length of the jet (FIG. 2).

Intervals of instability (indicated by the crosshatching in FIG. 2) are located between these points. Hartmann (J. Hartmann and B. Troll, "on a New Method for Generation of Sound Waves," Phys. Rev., 20:719–727 (1922), who did the first reported work in this field found that placing a cavity in one of the intervals of instability would cause a self-sustaining system of oscillations to be created by driving the gas in the cavity into resonance. The location of the instability region is directly downstream of the Mach disk. The jet impinges on the open end of the resonance tube with resulting change in the flow field.

Although there is continuous flow into and out of the resonance cavity, a portion of the gas remains trapped at the closed end and undergoes many cycles of periodic compression and rarefaction This periodic compression and expansion of the gas, within the rigid cavity of the resonance tube, produces irreversible temperature increases, which may be several times the initial adiabatic temperature head. The thermal energy generated by this process is concentrated at the closed end of the resonance tube and can be utilized to initiate exothermal processes requiring elevated temperature and/or heat flux as the initiation mechanism.

Figure 3:
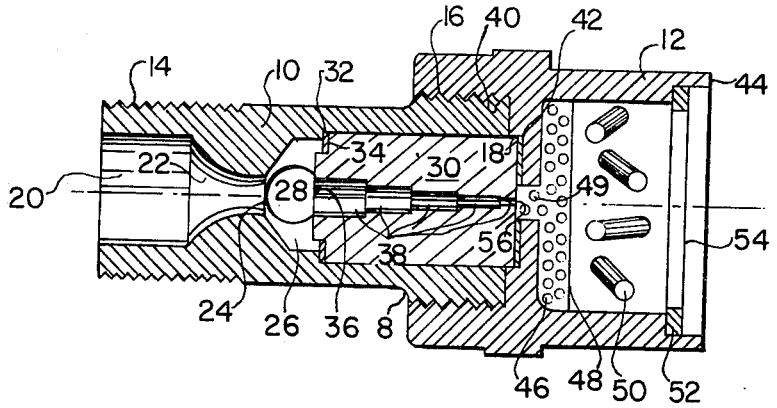
FIG. 3, Cross-sectional view of Flueric Cartridge Initiator taken along its longitudinal axis.

Referring now to FIG. 3 there is shown a housing 8 having a tube holder 10 removably mounted into an output charge holder 12. Although any high strength heat resistant material may be used in the manufacture of these major components steel is preferred and stainless steel 303 is most preferred.

The tube holder 10 is defined by an externally threaded aft end 14 and an externally threaded forward end 16 which is designed for mating to the aft end of the output charge holder 12. Leak proof mating of these two components is effected by incorporating a deformable, leak-tight output washer 18 intermediate the output charge holder 12 and the resonance tube 30. Although it is preferred that the output washer 18 be made of copper, any deformable material which has similar heat and corrosion resistivity is adequate. Incorporated through the threaded aft end 14 and along the longitudinal axis of the tube holder 10 is a nozzle 20 comprising a convergent zone 22, a throat 24, a divergent zone 26 and a transverse vent 28, passing through the divergent nozzle zone 26. Adjacent to the forward end of the nozzles divergent zone 26 and acting as a sealing gasket and separator between the nozzle 20 and the resonance tube 30 is an input washer 32. As with the output washer 18, it is preferred that the input washer 32 be made of copper, although any deformable material with similar heat and corrosion resistivity is adequate.

The forward end 16 of the tube holder 10 is machined along its longitudinal axis so as to accept the input washer 32 and the resonance tube 30. Additionally, a step 34 is machined on the end of the resonance tube 30 so as to properly seat the tube 30 inside the zone 26 and the stepped end 34 of the resonance tube 30.

The resonance tube 30 is machined or cast so as to comprise a resonance cavity inlet 36 and a plurality of axially oriented cylindrical resonance cavity segments 38. These segments 38 are arranged from aft to forward in order of decreasing diameter. Although the actual number of segments depends upon the precise size and operational requirements of the FCI, five segments ranging in diameter from the largest of 0.062 inches to the smallest of 0.010 inches is preferred.

In order to be effective resonance tube 30 material for cartridge initiator usage, the selected material must possess the following properties.

(1) Low thermal conductivity to ensure the heat generated by the entrapped gas is transferred through the steel disk to the ignition mix, not radially through the resonance tube walls. This will ensure reliable cartridge initiation.

(2) High service temperature to withstand the temperatures generated in the resonance tube after cartridge ignition.

(3) Resistance to thermal shock because of the rapid temperature increases of the gas entrapped in the resonance tube and cartridge ballistic gases.

(4) High compressive strength because of the high ballistic pressures required in some cartridge actuated device applications.

(5) Low porosity to prevent gas leakage through the resonance tube wall, and resultant heat loss.

(6) Easily moldable, castable, or machinable for production purposes. Table I is a summary of the physical properties of the most desirable resonance tube 30 materials.

The glass ceramics such as Cornings machinable glass ceramic (MGC) appeared to hold the most promise for successful firing. However, the test results indicated that polyester has the best thermal generating performance, could be cast, and has the significant advantage of being clear (thus allowing for visual inspection); but it has a low service temperature and compressive strength. Ultra Cast 553 had the highest service temperature, thereby having the capability of easily withstanding the anticipated high temperatures. Both of the polyesters, Ultra Cast 553 and Acme 555/655, were destroyed during each test firing. This produced low cartridge output pressures caused by backflow through the broken tube. The Corning MGC did withstand the temperature and forces produced by the cartridge.

TABLE I

SUMMARY OF PROPERTIES FOR THREE CANDIDATE RESONANCE TUBE MATERIALS

| Material | Compressive strength (kpsi) | Thermal conductivity (Btu) | Service temperature (° C) | Performance temperature[1] (° C) | Survived cartridge functioning |
|---|---|---|---|---|---|
| Acme 555/655 | 15.0 | 2 | 275 | 700 | No |
| (polyester) | 3.5 | 9 | 4,000 | 600 | No |
| Ultra Cast 553 | 50.0 | 12 | 1,800 | 600 | Yes |
| Corning MGC | | | | | |

[1]Resonance tube gas temperature after 25 ms with a 300 psi helium supply.

input washer 32, and thereby maintain the desired separation distance between the nozzle 20 and the resonance tube 30. After seating the input washer 32, the resonance tube 30 is loaded into the tube holder 10 through the forward end 16 thereby forming leak-tight seal between the foward end of this nozzles divergent The output charge holder 12 is defined on its aft end by an internally threaded section 40 and output washer seat 42. The forward end 44 of the output charge holder is machined so as to accept pyrotechnic transfer charge 46, closure disk 48, granulated double base output charge 50, copper crimp washer 52 and sealing disc 54. Although any common ignition material 46 will adequately work as the transfer charge, those of lead styphanate, lead azide, cellulose nitrate and potassium dinitrobenzfuroxane (KDNBF) are preferred. KDNBF is most preferable because it is safer to handle and it exhibits a slightly better response time. However, it is necessary to provide a means of protecting the KDNBF from being disrupted by the hot resonating gases. Therefore, a thin metal high strength protective disk 56 was incorporated into the system between the resonance tube and ignition mix.

The resonance tube 30 and transfer charge 46 interface is of vital importance to the proper ignition mode for the transfer charge 46. Optimum ignition conditions were obtained by packing a small column of KDNBF, 0.062 inches in diameter and 0.040 inches long, into pocket 49 so as to abut thermal disk 56. Additional KDNBF is then added to form a thin but large diameter (0.384 inch) layer. This layer is ignited by the small KDNBF column and produces an ignition surface suitable for igniting the output charge 50. This "Unique" (Hercules Powder Co., granulated double base) ignition output charge 50 is then capable of igniting the cartridge main charge propellant.

One of the original objects of this invention was to minimize the ballistic gas backflow through the resonance tube. It was anticipated that if the resonance tube material could withstand the temperature and pressures of cartridge ignition and if the 0.015-inch-diameter orifice did not erode, the output pressure would not be seriously degraded. However, computations indicated that a 0.015-inch-diameter hold will bleed enough ballistic gas to reduce the peak pressure from 13,000 psi to approximately 10,000 psi, a 25% reduction. Available options to effect disk 56 strengthening were material selection, thickness, and resonance tube hole diameter.

Figure 4:
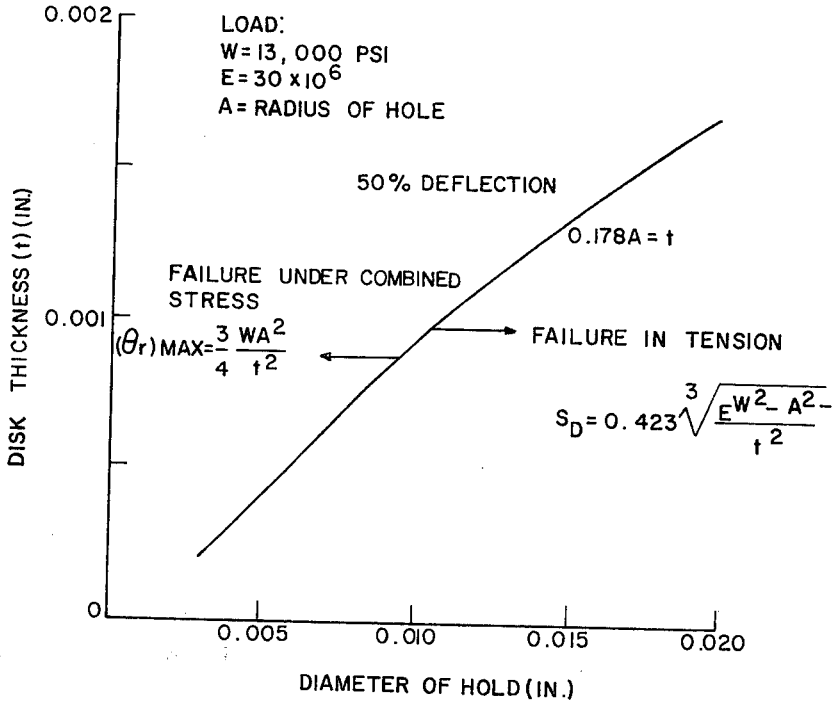
FIG. 4, Graphical Representation of failure modes of thin circular disks of various thickness.

A combination of the above options was found to be necessary. Failure of the thin disk 56 depends upon the deflection at the unsupported center. If the center deflects 50% or more of the thickness under load, then it will fail in tension. For less than 50% deflection, shear or combined stresses will cause failure. This dividing line is shown in FIG. 4 for the range of hole diameters and disk thicknesses considered.

Figure 5:
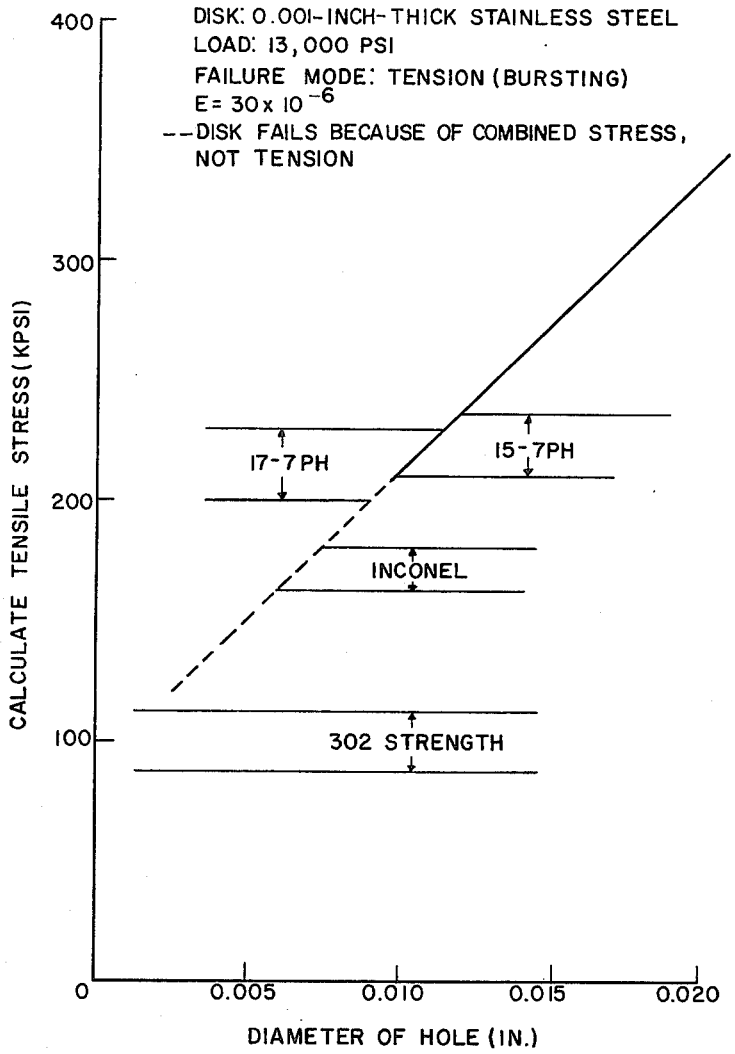
FIG. 5, Graphical Representation of Tensile Stress as a function of hole diameter.

The tensile stress for a 1-mil-thick disk 56 was calculated for various hold diameters and plotted in FIG. 5. This calculation indicates that, with a 1-mil-thick disk 56, the diameter of the hole must be reduced to about 0.010 inch, and high strength material such as 15–7 PH or 17–7 PH stainless steel must be used in order to keep the disk 56 intact.

The combined (yield) stress was similarly calculated and graphed for various disk thicknesses. From this it was determined that by using 15–7 PH or 17–7 PH stainless steel with a hole diameter of 0.010 inch will provide a safety factor of approximately 2.0 if the disk 56 is 1.5 mils thick.

The calculated tensile stress generated by a pulse of pressure 13,000 psi on a 1-mil-thick piece of stainless steel is 270,000 psi. Since the tensile strength of 15–7 PH stainless steel is 240,000psi (maximum), it would not be expected to survive. However, because of the transient nature of the pressure pulse, it was found that the 1-mil-disk will remain intact. In fact, a 1-mil disk of 302 stainless steel survived a 10,000-psi pulse with a 0.015-inch resonance tube hole.

Figure 6:
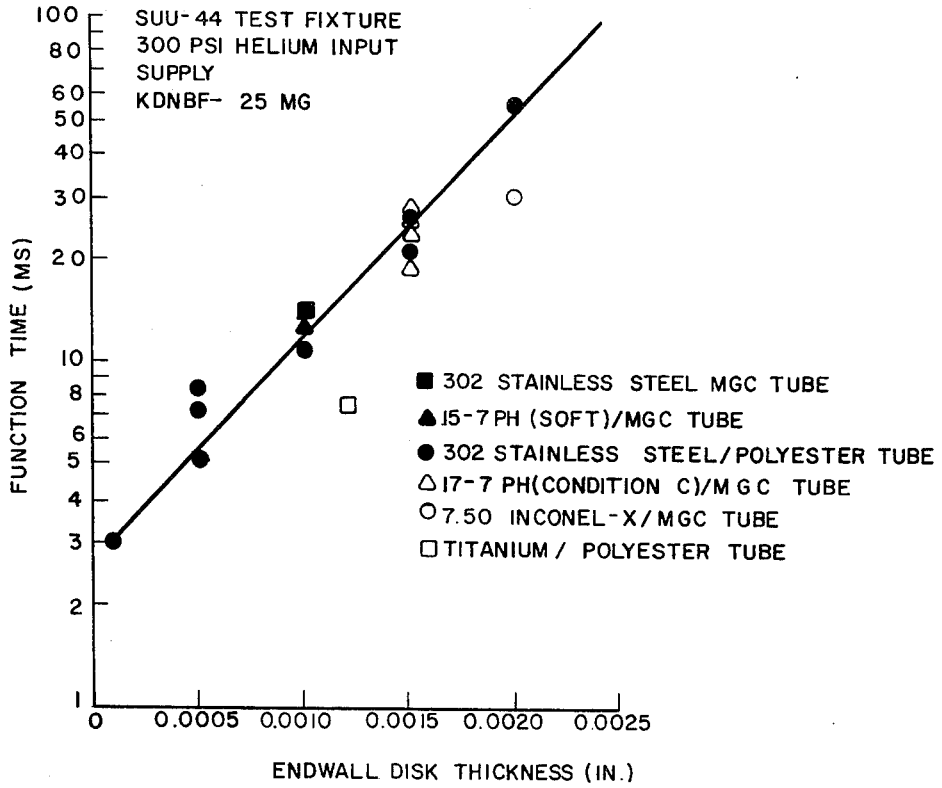
FIG. 6, Graphical representation of Flueric Cartridge Initiator performance versus disk thickness.

In order to assess the impact of employing higher strength and thicker disk materials, tests were conducted to determine cartridge initiation function time variation. The standard thermal disk was removed from cups of KDNBF and replaced with the newly designed disk. The disks were positioned against the resonance tube by a screwcap. The results shown in FIG. 6 indicate that the type of stainless steel is not an important considerations. Of more importance, is the thickness of the material. These tests indicate that it is possible to use disks 1.5 to 2.0 mils thick, but a penalty in function time is imposed.

EXAMPLE

Functional testing of fully loaded cartridges were conducted to insure reliability across the -65° to 200° F temperature range. The important parameters associated with FCI functional testing are: Fire/No Fire, Input gas pressure, peak pressure output and time to ignition (function time) defined as the time from start of gas supply to the first indication of pressure output from the cartridge.

In another definition, the function time is taken as the time from supply of electrical energy to the solenoid to initial cartridge pressure. Thus, it includes the time that it takes for the solenoid to open (15 to 30 ms). For the purposes of these tests, function time starts when pressure is recorded at the input pressure transducers. A summary of the tests is presented in Table II. Cartridge Mk 125 environmental/functional testing, employing both the standard electrical and gas initiation modes over the temperature range of −65° F to 200° F, is contained in Table III. Other testing with small amounts of KDNBF were used to determine function time only. These tests are summarized in Table IV.

Table II

FLUERIC CARTRIDGE INITIATOR TESTING IN THE CARTRIDGE MK 125

| Tube Material | Helium supply pressure (psi) | Solenoid time (ms) | Function time (ms) | Maximum cartridge pressure (psi) | Time to maximum pressure (ms) | Backflow (psi) | Resonance tube intact after firing | Remarks |
|---|---|---|---|---|---|---|---|---|
| | | | EARLY TEST UNITS | | | | | |
| Polyester | 300 | —[1] | —[1] | 8,271 | —[1] | 532 | No | |
| Polyester | 300 | —[1] | —[1] | 7,754 | —[1] | 1,000 | No | |
| Polyester | 300 | —[1] | —[1] | 9,473 | —[1] | 920 | No | |
| Ultracast | 300 | —[1] | —[1] | 9,305 | —[1] | 1,100 | No | |
| Ultracast | 300 | —[1] | —[1] | 8,777 | —[1] | 1,200 | No | |
| MGC | 300 | —[1] | —[1] | 5,690 | —[1] | —[1] | Yes | Holder eroded |
| MGC | 300 | —[1] | —[1] | 8,097 | —[1] | —[1] | Yes | Holder eroded |
| MGC | 300 | —[1] | —[1] | 9,535 | —[1] | —[1] | Yes | Holder eroded |
| Stainless steel/ polyester | 300 | —[1] | —[1] | 9,507 | —[1] | —[1] | Yes | Holder eroded |
| Stainless steel/ polyester | 300 | —[1] | —[1] | 1,334 | —[1] | —[1] | Yes | No orifice |

Table II-continued

FLUERIC CARTRIDGE INITIATOR TESTING IN THE CARTRIDGE MK 125

| Tube Material | Helium supply pressure (psi) | Solenoid time (ms) | Function time (ms) | Maximum cartridge pressure (psi) | Time to maximum pressure (ms) | Backflow (psi) | Resonance tube intact after firing | Remarks |
|---|---|---|---|---|---|---|---|---|
| | | | PRESENT TEST UNITS | | | | | |
| MGC | 477 | —[1] | 327 | 10,575 | 18 | —[1] | Yes | No O-ring |
| MGC | 318 | —[1] | 31 | 11,632 | 16 | —[1] | Yes | No O-ring |
| MGC | 474 | —[1] | 74 | 12,160 | 14 | —[1] | Yes | No O-ring |
| MGC | 367 | 23 | 25 | 10,033 | 12 | —[1] | Yes | No O-ring |
| MGC | 468 | 39 | 39 | 12,775 | 13 | —[1] | Yes | O-ring |
| MGC | 434 | 35 | 35 | 13,110 | 13 | —[1] | Yes | O-ring |
| MGC | 434 | 28 | 28 | 13,500 | 12 | —[1] | Yes | O-ring |
| MGC | 481 | 30 | 100 | 13,511 | 12 | —[1] | Yes | Blocked tube |

[1]Not recorded.

TABLE III

MK 125 CARTRIDGE TESTING WITH STANDARD ELECTRICAL INITIATION AND FCI/5

| Electrical initiation | Present Test Unit initiation | He input pressure (psi) | Solenoid time (ms) | Function time (ms) | Cartridge maximum pressure (psi) | Time to maximum pressure (ms) | Electrical delay time (ms) |
|---|---|---|---|---|---|---|---|
| | | 70° F Temperature Conditioned | | | | | |
| 1 | | | | | 11,688 | 15 | 6 |
| 2 | | | | | 12,089 | 14 | 6 |
| 3 | | | | | 12,089 | 10 | 10 |
| 4 | | | | | 12,356 | 13 | 6 |
| 5 | | | | | — | — | — |
| | 1 | 477 | 13 | 20 | 12,386 | 14 | |
| | 2 | 504 | 14 | 15 | 12,557 | 12 | |
| | 3 | 517 | 12 | 22 | 15,028 | 10 | |
| | 4 | 504 | 13 | 16 | 13,358 | 12 | |
| | 5[1] | — | — | — | — | — | — |
| | Average | | | 18.25 | | | |
| | σ | | | 3.3 | | | |
| | | −65° F Temperature Conditioned | | | | | |
| 6 | | | | | 11,612 | 16 | 8 |
| 7 | | | | | 13,892 | 17 | 7 |
| 8 | | | | | 12,022 | 17 | 8 |
| | 6 | 523 | 17 | 29 | 12,757 | 12 | |
| | 7 | 527 | 13 | 16 | 12,823 | 13 | |
| | 8 | 530 | 13 | 13 | 11,688 | 12 | |
| | 9 | 517 | 12 | 12 | 13,024 | 11 | |
| | 10 | 520 | 13 | 13 | 12,624 | 12 | |
| | 11[2] | — | — | — | — | — | |
| | 12 | 498 | 14 | 30 | 11,956 | 14 | |
| | 13 | 517 | 14 | 12 | 12,757 | 11 | |
| | 14 | 517 | 13 | 11 | 14,652 | 13 | |
| | 15 | 530 | 14 | 25 | 12,623 | 12 | |
| | Average | | | 17.89 | | | |
| σ | | | 7.82 | | | | |
| | | 200° F Temperature Conditioned | | | | | |
| 9 | | | | | 14,960 | 15 | 10 |
| 10 | | | | | 16,093 | 12 | 7 |
| 11 | | | | | 15,028 | 10 | 7 |
| | 16 | 517 | 11 | 11 | 16,364 | 10 | |
| | 17 | 520 | 15 | 16 | 15,292 | 10 | |
| | 18 | 517 | 15 | 15 | 17,365 | 10 | |
| | 19 | 504 | 14 | 11 | 15,361 | 11 | |
| | 20 | 523 | 15 | 16 | 15,361 | 11 | |
| | 21 | 517 | 14 | 14 | 16,364 | 10 | |
| | 22 | 516 | 15 | 14 | 17,365 | 9 | |
| | 23 | 471 | 15 | 11 | 15,048 | 9 | |
| | 24 | 490 | 15 | 12 | 15,495 | 10 | |
| | 25 | 506 | 13 | 13 | 15,361 | 11 | |
| | Average | | | 13.30 | | | |
| | σ | | | 2.0 | | | |

[1]No-fire, tube blocked.
[2]No-fire, concave end.

Table IV

FUNCTIONAL TESTING FLUERIC CARTRIDGE INITIATOR

| Gas Input Supply | Pressure (psi) | Function time (ms) |
|---|---|---|
| Helium | 470 | 14 |
| | 480 | 14.5 |
| | 500 | 19 |
| | 480 | No-fire[1] |
| Hydrogen | 475 | 7.5 |
| | 475 | 8.0 |
| | 475 | 10.0 |

Table IV-continued

FUNCTIONAL TESTING FLUERIC CARTRIDGE INITIATOR

| Gas Input Supply | Pressure (psi) | Function time (ms) |
|---|---|---|
| | 480 | 10.5 |
| | 480 | 218[1] |

[1]Resonance tube not cleaned.

Cartridge functional times of 11 ms have been obtained with helium input gas. The data indicated that the FCI function times are related to solenoid operations-the faster the valve functions, the faster the FCI functions. Results of the limited hydrogen FCI testing (Table V) seemed to confirm analytical predictions that the hydrogen would provide faster function times than helium.

Thus, it is apparent that there is provided by this invention a flueric cartridge initiator capable of withstanding high ballistic gas pressures and having a minimum response time.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. In combination with a flueric cartridge initiator of the type wherein a housing being defined by aft and forward ends, includes a convergent-divergent nozzle axially incorporated through said aft end, a transverse vent passing through the divergent zone of said nozzle and axially oriented with said nozzle, a resonance tube having a plurality of resonance cavities aligned in decreasing size order along the longitudinal axis of said resonance tube, and wherein a pyrotechnic transfer charge in juxtaposition with said resonance tube is ignited by thermal energy generated as a gas introduced into said flueric cartridge initiator through said nozzle undergoes periodic compression and expansion within said resonance cavities, the improvement which comprises: means for sealing said flueric cartridge initiator so as to prevent gas blowback, wherein said means includes:

said convergent-divergent nozzle also forming a tube holder having an externally threaded forward end, said forward end being machined along its longitudinal axis so as to accept a deformable input washer;

said resonance tube, inserted into said tube holder so as to form a leak-tight seal with said input washer when said flueric cartridge initiator is fully loaded, an output charge holder having an internally threaded aft end for mating with forward end of said tube holder;

a deformable output washer, for creating a leak-tight seal between the forward end of said resonance tube and said output charge holder; and a high strength thermal disk for preventing gas blowback from said transfer charge; and said transfer charge, including a small diameter section of ignition material adjoining a larger thin layer section of ignition material, thereby permitting ignition of said transfer charge.

2. The combination of claim 1 wherein said input and output washers are made from copper.

3. The combination of claim 1 wherein said resonance tube is made from a material selected from the group consisting of castable polyester, a machinable glass ceramic and steel.

4. The combination of claim 3 wherein said resonance tube is made from a machinable glass ceramic.

5. The combination of claim 1 wherein said transfer charge is selected from the group consisting of potassium dinitrobenzfuroxane, lead styphnate, lead azide, and cellulose nitrate.

6. The combination of claim 5 wherein said transfer charge is potassium dinitrobenzfuroxane.

7. The combination of claim 1 wherein said high strength thermal disk is steel.

8. The combination of claim 7 wherein said steel is selected from the group consisting of 15–7 PH and 17–7 PH stainless steel.

9. The combination of claim 7 wherein said thermal disk is from 1 to 2 mils thick.

* * * * *